US012305498B2

(12) United States Patent
Fripp et al.

(10) Patent No.: US 12,305,498 B2
(45) Date of Patent: May 20, 2025

(54) DOWNHOLE FLUID SEPARATOR IN A MULTILATERAL WELL

(71) Applicant: Halliburton Energy Services, Inc., Houston, TX (US)

(72) Inventors: Michael Linley Fripp, Singapore (SG); Zac Arackakudiyil Suresh, Dhahran (SA); Muhammad Arra'uf Abdul Shukor, Dhahran (SA)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/581,202

(22) Filed: Feb. 19, 2024

(65) Prior Publication Data

US 2025/0084748 A1 Mar. 13, 2025

Related U.S. Application Data

(60) Provisional application No. 63/582,158, filed on Sep. 12, 2023.

(51) Int. Cl.
*E21B 43/38* (2006.01)
*E21B 43/12* (2006.01)
*E21B 43/14* (2006.01)

(52) U.S. Cl.
CPC ..... *E21B 43/385* (2013.01); *E21B 43/128* (2013.01); *E21B 43/14* (2013.01)

(58) Field of Classification Search
CPC ..... E21B 43/128; E21B 43/14; E21B 43/385; E21B 43/40
See application file for complete search history.

(56) References Cited

U.S. PATENT DOCUMENTS 5,711,374 A * 1/1998 Kjos ..... B04C 5/28 166/243
6,336,503 B1 1/2002 Alhanati et al.
(Continued)

FOREIGN PATENT DOCUMENTS

CN 113338875 9/2021
WO 9630625 10/1996

OTHER PUBLICATIONS

"PCT Application No. PCT/US2024/016790, International Search Report and Written Opinion", Jun. 26, 2024, 12 pages.

*Primary Examiner* — David Carroll
(74) *Attorney, Agent, or Firm* — DeLizio, Peacock, Lewin & Guerra LLP

(57) ABSTRACT

A multilateral well system comprises a fluid separator to be positioned at a junction between a main bore and a lateral well of a multilateral well, wherein the fluid separator is configured to receive a formation fluid and to separate the formation fluid into production fluid and nonproduction fluid. The multilateral well system includes a pump to be positioned at the junction and configured to pump the nonproduction fluid to the lateral well for injection of the nonproduction fluid into a subsurface formation surrounding the at least one lateral well. The multilateral well system includes a first flow channel configured to be a conduit for delivery of the production fluid to the surface of the multilateral well and a second flow channel configured to deliver an injection of a surface fluid from the surface of the multilateral well into an injection zone downhole in the multilateral well.

20 Claims, 2 Drawing Sheets

(56) References Cited

U.S. PATENT DOCUMENTS

| | | | | |
|---|---|---|---|---|
| 6,547,003 | B1 * | 4/2003 | Bangash | E21B 43/40 166/66.4 |
| 6,923,259 | B2 | 8/2005 | Snow | |
| 10,583,373 | B2 | 3/2020 | Braaten et al. | |
| 2011/0079388 | A1 | 4/2011 | Cox | |
| 2017/0022761 | A1 * | 1/2017 | Joshi | E21B 43/128 |
| 2017/0022797 | A1 * | 1/2017 | Joshi | E21B 43/385 |
| 2017/0268322 | A1 | 9/2017 | Culbertson et al. | |
| 2018/0154282 | A1 | 6/2018 | Braaten et al. | |
| 2022/0403726 | A1 * | 12/2022 | Al-Qasim | E21B 43/40 |
| 2023/0220759 | A1 * | 7/2023 | Alrabaei | E21B 43/40 166/265 |

* cited by examiner

DOWNHOLE FLUID SEPARATOR IN A MULTILATERAL WELL

BACKGROUND

Oil and gas wells produce significant amounts of water in their lifetime. The percentage of water produced from these wells is called the water cut, the ratio of the water produced from the well compared to the volume of the total liquids produced. Most wells produce an ever-increasing water cut throughout their productive life. In many oil fields around the world the percentage of water recovered with oil has risen to be greater than the percentage of the oil. In fact, in many fields, the percentage of oil has decreased to be from about 20% in an excellent field to about 2% in a relatively poor field.

The end of a well's productive life is often determined by the water cut. A well is typically shut in when the value of the hydrocarbons produced is no longer sufficient to economically cover the operating costs of the well and the cost of disposing of the produced water. Indeed, disposing of the produced water is not environmentally and economically friendly as energy is used to power the pump to lift the produced water to the surface, to separate the produced water from the oil, to transport the separated water as it cannot be disposed on the surface in most cases. Thus, the separated water must be transported to a remote well site to be reinjected into a subterranean formation. Therefore, decreasing the water cut of a well increases the value of the produced fluids and directly decreases the disposal costs of the produced water.

One method of reducing the water cut of a well is to separate produced water from the hydrocarbons downhole, rather than at surface. Downhole separation increases the value of the fluids produced to the surface. Downhole separation also facilitates disposal of the separated water. The separated water can be reinjected into the same production zone or into a different production zone. Another way to improve the productivity of a well is to increase the length of the intersection of the productive zone by the well completion. One way of increasing this intersection length is by using multilateral wells. A multilateral well is a conventional well that has a lateral well that is drilled from a point in the original well. The lateral well increases productivity by allowing additional intersection length along the productive zone without the cost and delay involved in redrilling the upper part of the well. While multilaterals enable multiple intersections within the same productive zone, multilaterals also enable fluid communication with different productive zones within a reservoir. In certain reservoirs, operators can leverage this approach to improve reservoir production by accessing numerous production zones or by increasing the contact area between a wellbore and a formation with minimal increase in drilling and completion costs. These techniques also reduce the environmental footprint of drilling rigs and subsequent production trees, particularly for land operations. Therefore, the use of multilateral well increases the potential production of a well and can also enable disposal of the produced water in a different zone.

BRIEF DESCRIPTION OF THE DRAWINGS

Embodiments of the disclosure may be better understood by referencing the accompanying drawings.

DESCRIPTION

Figure 1:
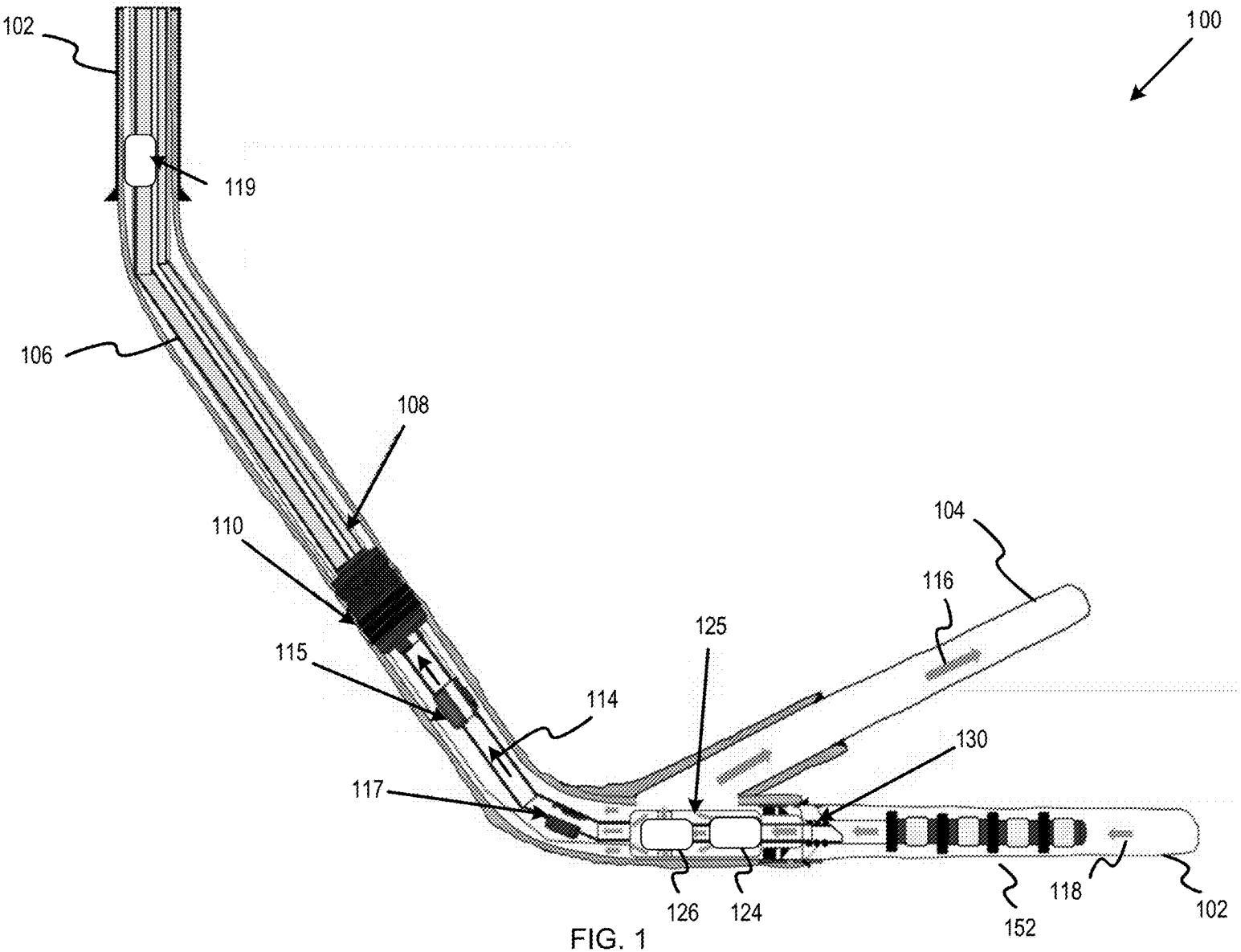
FIG. 1 is a perspective view in partial cross section of a multilateral well system that includes a fluid separator installed at a junction between the main bore and the lateral bore, according to some embodiments.

The description that follows includes example systems, methods, techniques, and program flows that embody aspects of the disclosure. However, it is understood that this disclosure may be practiced without these specific details. In some instances, well-known instruction instances, protocols, structures, and techniques have not been shown in detail in order not to obfuscate the description.

Example implementations may include a wellbore system that includes a downhole fluid separator. For example, the system may be part of a multilateral well completion design that includes a fluid separator at the junction between the main bore and a lateral well on the upper completion. A fluid separator may provide separation of different types of fluids. For example, the fluid separator may separate a formation fluid (received from the formation surrounding on the main bore) into production fluid and nonproduction fluid. For instance, the fluid separator may include an oil/water separator and a gas/oil/water separator, etc. In some implementations, the system may include a pump (such as an electrical submersible pump (ESP)) at the junction to pump the nonproduction fluid (such as water) into the lateral well so that the nonproduction fluid is injected into the subsurface formation surrounding the lateral well.

Additionally, some implementations may include a first tubing string for the delivery of production fluid (separated out) from downhole to the surface of the multilateral well. Some implementations may also include a second tubing string for the delivery of a sample of nonproduction fluid (separated out) to the surface of the multilateral well. Alternatively or in addition, the second tubing string may be used for the delivery of a surface fluid downhole for its injection into a formation. For example, the surface fluid may be water that is injected into the injection zone of the formation surrounding the lateral well. While described as separate tubing strings, at least one of the first tubing string or the second tubing string may be any type of flow channel. For example, the first tubing string may be a tubing string, while the second tubing string may be the annular space around the first tubing string.

The system may also include a packer positioned above the junction and configured to expand to seal off this part of the main bore. The packer may also be configured to be coupled to the first tubing string and the second tubing string for fluid communications between downhole and the surface of the multilateral well. The system may also include a second pump (such as an electrical submersible pump) positioned in the first tubing string to provide an artificial lift of the production fluid if the production pressure is insufficient.

Thus, in some implementations, the fluid separator may be installed inside the junction between the main bore and the lateral well. In other implementations, the fluid separator may be installed below this junction or above this junction. Further, the main bore may include an orientation liner hanger which provides depth and orientation control. The fluid separator may be installed in a horizontal configuration. In some implementations, the fluid separator may be placed in the main bore at the junction between the main bore and the lateral well with a pump such as an electrical submersible pump (ESP) disposed above the fluid separator.

The multilateral junction may be placed above or inside the target formation. In some implementations, this configuration may be accomplished in a two-trip multilateral completion that includes a lower completion with orientation liner hanger connected to additional lower completion, and an upper completion that includes the fluid separator, an electrical submersible pump, and an upper packer. This simplifies the installation. This reduced complexity allows the fluid separator to be installed into existing wells, i.e., retrofitting existing wells. Further, the lateral well may be a target formation. In this implementation, the main bore passes through a target production formation and the lateral bore passes through a target injection formation which is a separate formation from the production formation. The existing wells do not require a tangent section at the junction for the placement of the fluid separator, significantly increasing the number of oil well candidates for installation of the fluid separator according to example implementations.

The design of the installed completion equipment may be critical for the downhole fluid separator to function as intended. Current well designs place the downhole fluid separator above the multilateral junction. By installing the fluid separator in the main bore at the junction between the main bore and the lateral well with a pump such as an electrical submersible pump disposed above the fluid separator according to example implementations, an existing watered out well can be re-entered, and a new lateral added to it. This decreases the overall cost involved in installing the fluid separator according to example implementations as compared with installing it at the completion of the well at the beginning of the life of the well. It also decreases the risks associated with installing downhole fluid separator according to example implementations as existing wells that are already poor producers may be selected as candidates and represent a smaller cost if the well is lost during the trial as compared with selecting a potential well before well completion is finished. Using a fluid separator in a downhole setting combined with a multilateral junction provides efficiency gains.

This includes converting poor performing wells, wherein the percentage of oil has decreased to about 2% for example, into a downhole water injector combined with a better producing well. Additional benefits include lower flow rate and pressure rating requirements, a lighter fluid column, and increased recovery. The fluid separator according to example implementations may be particularly useful in low flow rate wells (in the 200 barrel per day range or less), which tend to be shallow, and relatively inexpensive to drill. Moderate flow rate wells, for example 500-5000 barrels of fluid per day, may also be potential candidates for the downhole fluid separator according to example implementations. Finally, it will also be useful for most multilaterals with very high flow rate wells, up to 50,000 barrels of fluid per day, for example.

Example System

FIG. 1 is a perspective view in partial cross section of a multilateral well system that includes a fluid separator installed at a junction between the main bore and the lateral bore, according to some embodiments. In this example, the multilateral well is a Technology Advancement of Multilaterals (TAML) level 4 with re-entry packer allowing for the creation of a lateral well in existing wells or new wells according to an example embodiment of the present disclosure. However, example implementations may include multilateral wells of other TAML levels (as further described below).

FIG. 1 depicts a multilateral well that includes a main bore 102 and a lateral well 104. In FIG. 1, a system 100 includes a component 125 that includes a fluid separator 124 and a first pump 126 that are positioned at the junction between the main bore 102 and the lateral well 104. The system 100 may also include a packer 110, sensors 115, a swivel 117, a second pump 119, a first tubing string 106, and a second tubing string 108.

The main bore 102 may include an open hole horizontal. The lateral well 104 may be an open hole inclined well. The main bore 102 may also include a lower completion with packers and screens 152. The packers and screens 152 may include an MLT anchor packer. The packers and screens 152 may include the ability for lateral sidetrack for a level 4 well. The packers and screens 152 may include the ability for depth and orientation control of the fluid separator 124. The packers and screens 152 may operate to anchor the screens and isolate the 9⅝ inch casing and 7-inch liner. The swivel 117 may allow for self-orientation of the fluid separator 124 into the packers and screens 152 without compromising the upper dual tubing string and the cable for the pump 119. In some implementations, the pump 119 may be an electrical submersible pump (ESP). The pump 119 may be used and/or part of the multilateral well system to provide an artificial lift if the filtered oil pressure is insufficient. As shown, the pump 119 may be positioned in the first tubing string 106.

The packer 110 may be positioned in the main bore 102 above the junction. In some implementations, the packer 110 may be a retrievable electrical submersible pump packer. The lateral well 104 may be at an inclined angle. The lateral well 104 may be in the production zone or a different zone. The fluid separator 124 and the first pump 126 may be located at the junction with the lateral well 104 in the horizontal section. A production packer may be located above and adjacent to the orientation liner hanger 130. The production packer may be any packer capable of providing a seal between the outside of the production tubing and the inside of the casing.

The first pump 126 may be any pump capable of drawing formation fluid and to pump it up hole such as an electrical submersible pump located after the fluid separator 124. In some implementations, the first pump 126 may be used to power the fluid separator 124 to draw the formation fluid 118 through the fluid separator 124. The first pump 126 may be outputting a higher pressure nonproduction fluid 116 (such as water) into the lateral well 104. The production fluid 114 is bypassing the first pump 126 after the fluid separation.

As the formation fluid 118 is drawn to the fluid separator 124, production fluid (such as oil) may be separated and set uphole through the annulus while nonproduction fluid (such as water) is sent to the lateral well 104 for injection back to the formation. Therefore, the nonproduction fluid may be separated downhole and directed back to the formation without any need to pump it back to the surface for separation and any transportation needed for storage. The packer 110 located in the upper completion helps in pumping the production fluid to the surface via the first tubing string and sealing the nonproduction fluid in the lower tubing string as it isolates the 9⅝ casing between the two zones. The packer 110 may include a pump cable for the pump 119 and may include a tubing encased conductor (TEC) line feed through.

In some implementations, the second tubing string 108 may deliver surface fluid (such as water) downhole for injection in the formation surrounding the lateral well 104. For instance, the surface fluid may be delivered downhole for injection in the formation surrounding the lateral well 104 to assist with hydrocarbon recovery in this or a different well. In some implementations, the surface fluid may be chemicals to be injected into the formation to treat the formation to facilitate or enhance hydrocarbon recovery downhole. The nonproduction fluid 116 may include silicon, sand, etc. in combination with water. This silicon, sand, etc. may create filter cakes in the formation surrounding the lateral well 104. These filter cakes may make it more difficult to push the water therein. In these situations, the surface fluid (which may be water, acid, etc.) may be delivered via the second tubing string 108 into the lateral well 104 to help remove these filter cakes. In some implementations, the surface fluid may be water sent to the surface of a different well. This allows for the disposal of the water delivered to the surface of a different well back into a subsurface formation.

In some implementations, the surface fluid may be a cleanup fluid, wherein the injection of cleanup fluid (such as pressurized water, acid, etc.) may be initiated by the operator or may be automated. In an automatic operation, the time for injecting cleanup fluid may be predetermined such as on a fixed schedule (such as every 30 days), at a fixed rate (such as 1 liter/day) and at a fixed ratio (such 1 liter per 1000 barrels of nonproduction fluid). In some implementations, injection of the cleanup fluid may be determined based on changes in the resistance of the formation, such as an increase in measured downhole pressure at the sensor 115, a change in the power used by the pump 126, or changes in the production rates. The injection of the cleanup fluid may be determined at the surface by noting the pump pressure and pump flow rate needed for the injection of wastewater fluids into the injection formation.

In some implementations, the second tubing string 108 may also deliver a sample of the nonproduction fluid 116 to the surface of the multilateral well. Testing of this sample of the nonproduction fluid 116 may be used to determine if the concentration of silicon, sand, etc. is present therein to lead to filter cakes being formed in the formation surrounding the lateral well 104. Testing of this sample of the nonproduction fluid 116 may also be used to determine that the fluid separation downhole is operating correctly. For example, if the concentration of hydrocarbons is too high, operation of the pump 126 may be adjusted to allow for better separation between the production fluid 114 and the nonproduction fluid 116. For instance, speed of the pump 126 may be increased or decreased to allow for greater separation. The speed of the pump 126 may also be increased or decreased to adjust the injection pressure of the nonproduction fluid 116.

The system 100 may also include four production packers and screens 152 and positioned in the open hole horizontal production zone of the main bore 102. The orientation liner hanger 130 may anchor the screens and isolate the 9⅝ inch casing and 7-inch liner. This way, a formation fluid 118 can be cleaned before entering the fluid separator 124. The clean formation fluid is then separated into a production fluid 114 (such as oil) and a nonproduction fluid 116 (such as water). The production fluid 114 may be drawn by the first pump 126 in the annulus to the surface through the packer 110 (and up through the first tubing string 106). Different number of production packers and screens 152 may be used and may be used in a cased hole production zone of the main bore 102.

The nonproduction fluid 116 may be drawn by the first pump 126 to the tubing string to the lateral well 104 and injected into the formation through the lateral open hole section. Therefore, nonproduction fluid may be separated downhole and directed back to the formation without any need to pump it back to the surface for separation and any transportation needed for storage.

The sensors 115 may include pressure and/or temperature sensors that are added in between the orientation liner hanger and the packer 110 in the main bore 102. The sensors 115 may include a pressure gauge sensor located below and adjacent to the packer 110. In some implementations, the sensors 115 may include a triple gauge sensor. The sensors 115 may monitor pressure and temperature of at least one of the production fluid or the nonproduction fluid. This pressure measurement of the tubing/casing annulus pressure may help in monitoring produced production fluid and re-injected nonproduction fluid so that the first pump 126 may be controlled accordingly. Other pressure gauges may be added anywhere between the production packer and the packer 110.

In some implementations, fixed restrictors (inflow control devices) or adjustable restrictors (inflow control valves) may be located between the pump 126 and the injection lateral 104. This way, the formation fluid may be cleaned, and its flow controlled while drawing the fluid from the formation and when injecting formation water to the injector. Interval control valve may be any valve operated automatically (autonomous inflow control device), manually, or remotely as part of an intelligent completion. Interval control valve may control multiple zones selectively, reduce water and gas cuts, and maximize oil productivity. The addition of the interval control valve and the shrouded interval control valve with retrievable tubing plug allow for control of the flow of the water injection intake in the tubing casing annulus and control of the oil production intake from the separator via the interval control valve microannulus. This design maximizes oil production but also production of formation water for sampling if needed.

Example Operations

Figure 2:
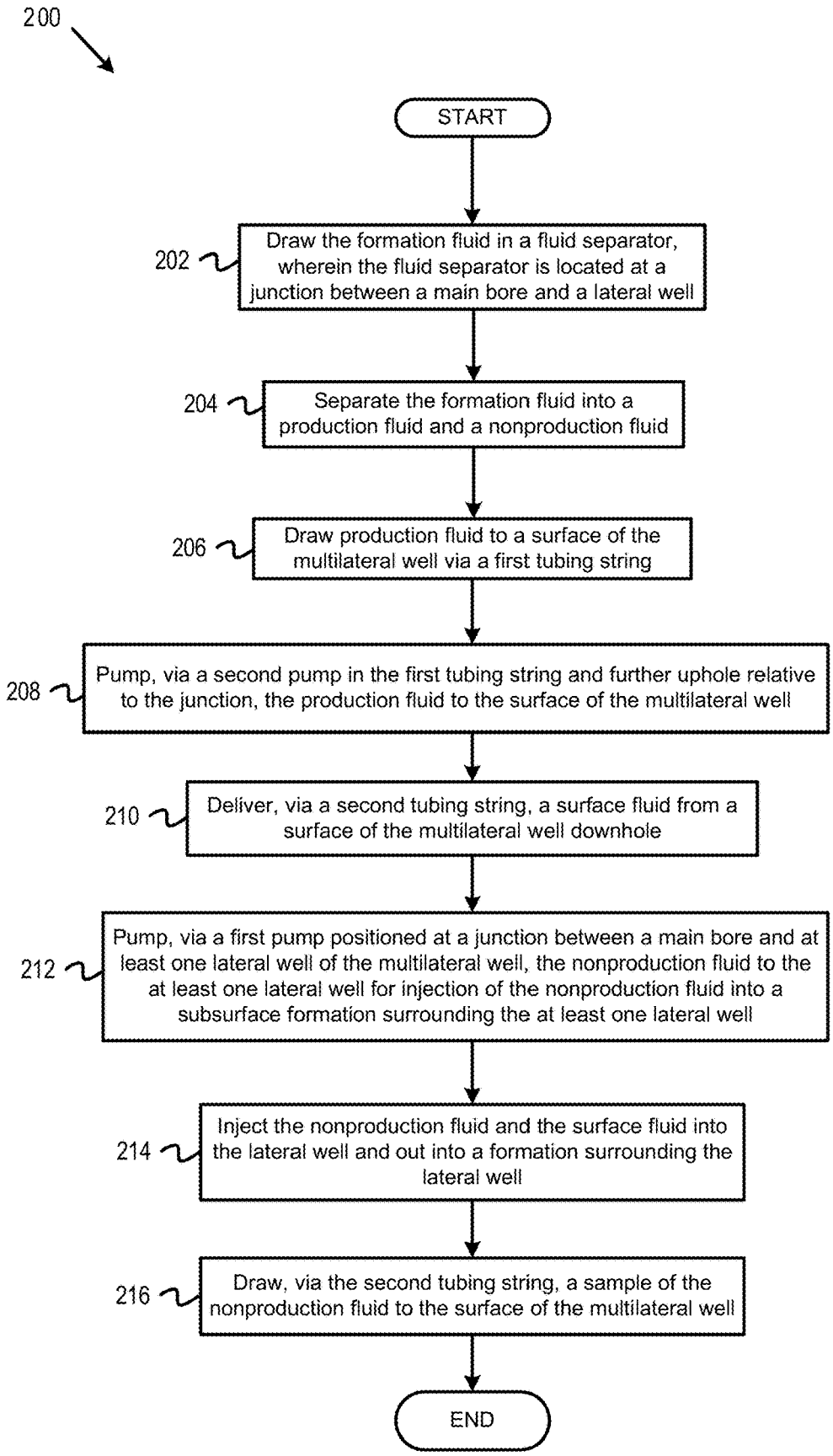
FIG. 2 is a flowchart of example operations for performing downhole separation, according to some embodiments.

Example downhole separation operations are now described. In particular, FIG. 2 is a flowchart of example operations for performing downhole separation, according to some embodiments. Operations of a flowchart 2 of FIG. 2 can be performed by software, firmware, hardware, or a combination thereof. Operations of the flowchart 200 are described in reference to the example system of FIG. 1. However, other systems and components can be used to perform the operations now described. The operations of the flowchart 200 start at block 202.

At block 202, formation fluid is drawn into a fluid separator that is located at a junction between a main bore and a lateral well of a multilateral well. For example, with reference to FIG. 1, the formation fluid 118 may be drawn into the fluid separator 124.

At block 204, the formation fluid is separated into a production fluid and a nonproduction fluid. For example, with reference to FIG. 1, the fluid separator 124 separates the formation fluid 118 into a production fluid 114 and a nonproduction fluid 116.

At block 206, the production fluid is drawn to a surface of the multilateral well via a first tubing string. For example, with reference to FIG. 1, the production fluid 114 is drawn to the surface of the multilateral well via the first tubing string 106 (through the packer 110).

At block 208, the production fluid is pumped, via a second pump in the first tubing string and further uphole relative to the junction, to the surface of the multilateral well. For example, with reference to FIG. 1, the pump 119 in the first tubing string 106 may pump the production fluid to the surface of the multilateral well.

At block 210, a surface fluid is delivered, via a second tubing string, from a surface of the multilateral well downhole. For example, with reference to FIG. 1, a surface fluid (such as water) may be delivered downhole into the multilateral well via the second tubing string 108. For instance, the surface fluid (such as water) may be delivered downhole for injection in the formation surrounding the lateral well 104 to assist with hydrocarbon recovery in this or a different well. In some implementations, the surface fluid may be chemicals to be injected into the formation to treat the formation to facilitate or enhance hydrocarbon recovery downhole. For example, the nonproduction fluid 116 may include silicon, sand, etc. in combination with water. This silicon, sand, etc. may create filter cakes in the formation surrounding the lateral well 104. These filter cakes may make it more difficult to push the water therein. In these situations, the surface fluid (which may be water, acid, etc.) may be delivered via the second tubing string 108 into the lateral well 104 to help remove these filter cakes. In some implementations, the surface fluid may be water sent to the surface of a different well. This allows for the disposal of the water delivered to the surface of a different well back into a subsurface formation.

At block 212, the nonproduction fluid is pumped, via a first pump positioned at a junction between a main bore and at least one lateral well of the multilateral well, to the at least one lateral well for injection of the nonproduction fluid into a subsurface formation surrounding the at least one lateral well. For example, with reference to FIG. 1, the pump 126 may pump the nonproduction fluid 116 to the lateral well 104.

At block 214, the nonproduction fluid and the surface fluid are injected into the lateral well and out into a formation surrounding the lateral well. For example, with reference to FIG. 1, the nonproduction fluid 116 that was separated by the fluid separator 124 and any surface fluid delivered from the surface downhole via the second tubing string 108 (wherein each or both of such fluids may be composed of water) may be injected into the formation surrounding the lateral well 104.

At block 216, a sample of the nonproduction fluid is drawn, via the second tubing string, to the surface of the multilateral well. For example, with reference to FIG. 1, the second tubing string 108 may also be used to draw a sample of the nonproduction fluid 116 to a surface of the multilateral well. Accordingly, the second tubing string 108 may be used to draw a sample of the nonproduction fluid 116 to a surface of the multilateral well at a first time and may be used to deliver a surface fluid downhole for injection into the formation surrounding the lateral well 104 at a second time. Testing of this sample of the nonproduction fluid 116 may be used to determine if the concentration of silicon, sand, etc. is present therein to lead to filter cakes being formed in the formation surrounding the lateral well 104. Testing of this sample of the nonproduction fluid 116 may also be used to determine that the fluid separation downhole is operating correctly. For example, if the concentration of hydrocarbons is too high, operation of the pump 126 may be adjusted to allow for better separation between the production fluid 114 and the nonproduction fluid 116. For instance, speed of the pump 126 may be increased or decreased to allow for greater separation.

Example Multilateral Wells

While described in reference to be used in a TAML Level 4 well, example implementations may be performed in other TAML Level wells. In particular, multilateral wells are characterized according to definitions established in 1997 during a Technology Advancement of Multilaterals (TAML) Forum held in Aberdeen. These standards classify junctions as TAML Level 1, 2, 3, 4, 5, or 6 based on mechanical complexity, connectivity, and hydraulic isolation. The ascending order of these levels reflects increasing mechanical and pressure capability of the junction. Consequently, cost, complexity, and risk also generally increase at the higher TAML levels. However, other considerations of the well design also influence the overall complexity of the well—for example, a TAML Level 2 well with an advanced intelligent completion can be more complex and costly than a TAML Level 5 well with a simpler completion system.

In a TAML 1 well, the main bore, lateral, and junction are uncased. This basic lateral is designed to enhance reservoir drainage from consolidated formations. It has the advantage of low drilling and completion costs, but the open hole junction makes reentry into the lateral wellbore and control of flow from the lateral impossible.

Wells that have cased and cemented main bores and open hole laterals are designated TAML Level 2. A cemented main bore significantly reduces the risk of wellbore collapse and provides isolation between laterals. By placing sliding sleeves and packers in the main bore, operators can produce the bores singly or in commingle production.

Placing a liner in the lateral and mechanically connecting it to the cased and cemented main bore results in a TAML Level 3 well. A liner is a string of casing that does not extend to the surface but is anchored or suspended inside a previously run casing string. This TAML Level 3 well includes a lateral that is cased but not cemented at the junction. It is a relatively low-cost option that includes reentry capabilities and a lateral that is better supported than that of Levels 1 and 2. Using sliding sleeves and packer plugs, operators can produce the bores singly or in commingle production. A TAML Level 3 junction does not provide hydraulic isolation, and its use is restricted to consolidated formations.

TAML Level 4 junctions are applicable in both consolidated and unconsolidated formations because both the lateral and the main bore are cased and cemented at the junction. The junction provides full bore access to the lateral, and mechanical support is supplied by the tubulars and cement. However, because the cement can only withstand limited differential pressure, the junction does not provide hydraulic isolation.

TAML Level 5 wells do provide hydraulic isolation at the junction because pressure integrity is provided by the completion, which includes production tubing connecting a packer in the main wellbore above the junction and a packer in the lateral wellbore. Because hydraulic isolation and support are provided by the completion hardware, the junction may be a TAML Level 2, 3, or 4 before the Level 5 completion is installed. TAML Level 6 wells also provide hydraulic isolation at the junction. A well at this level differs from a TAML Level 5 well in that pressure integrity is provided by the main wellbore casing and a cemented or uncemented liner in the lateral. The cost and complexity of creating a single-metal-element dual-bore casing junction downhole has prevented TAML Level 6 wells from being developed. As of today, the category exists as a result of early experiments. Because multilateral wells that have higher TAML designations are generally more complex, they are more costly, and their configurations are more flexible. As they do with multilateral geometry, engineers choose a TAML level junction based primarily on reservoir characteristics, costs, and function.

The ability to reenter the lateral for well intervention operations is another multilateral well design consideration. Because it is a directionally drilled section that has no junction, the lower lateral is almost always easily accessed using standard intervention methods. Operators must make an economics-based decision during the well planning stage to include junctions that allow lateral access after pulling the upper completion, through-tubing access, junctions that can be adopted to allow access after installation or junctions through which no access is possible to main bore, lateral, or both. If the well includes more than one lateral, a selective through-tubing access system would need to be considered. The decision to deploy lateral junctions that allow full bore or restricted access is a function of the overall well design. Engineers usually opt for full bore access if a packer is to be placed below the junction or if an artificial lift system must be located near the lower lateral. In addition, based on their knowledge of the reservoir, operators may require full bore access to perform perforating, stimulation, logging, water shutoff, gravel packing, cleanout, and other remedial operations. Full bore access can be adapted to all TAML level junctions but must be specified before installation; some commercially available junctions allow no access or only restricted access to either the lateral or the main bore and cannot be adapted after installation.

The decision to use a multilateral well system and what type to use are the result of cost benefit analyses. In general, the less-complex junctions present operators with lower risks and costs. But risk mitigation and cost savings must be balanced against individual well and field development expectations. In low-value reservoirs, a simple open hole lateral that has no reentry capability may increase ultimate reserve recovery or accelerate production while having little impact on overall drilling and completion costs. In high-value deepwater plays, installing a hydraulically sealed TAML Level 5 or 6 junction can drive total well costs into millions of dollars and still be a good investment because it may save drilling another well with a complex and tortuous trajectory, preserve a well slot on an existing production platform, or eliminate the need entirely to procure and install additional subsea infrastructure.

In embodiments, a multilateral well is drilled and completed with a TAML Level 4 junction. The junction includes a pump and a fluid separator. The pump includes any pump capable of drawing in fluid through the pump intake, pressurizing it, and lifting it to the surface such as an electrical submersible pump. The fluid separator and the pump can be above, at, or below the junction. The upper completion includes a retrievable electrical submersible pump packer while the lower completion has an orientation liner hanger.

While the aspects of the disclosure are described with reference to various implementations and exploitations, it will be understood that these aspects are illustrative and that the scope of the claims is not limited to them. Many variations, modifications, additions, and improvements are possible. Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed. As used herein, the term "or" is inclusive unless otherwise explicitly noted. Thus, the phrase "at least one of A, B, or C" is satisfied by any element from the set {A, B, C} or any combination thereof, including multiples of any element.

Example Embodiments

Example embodiments are now described.

Embodiment #1: A multilateral well system comprising: a fluid separator to be positioned at a junction between a main bore and at least one lateral well of a multilateral well, wherein the fluid separator is configured to receive a formation fluid from a subsurface formation surrounding the main bore, wherein the fluid separator is configured to separate the formation fluid into production fluid and nonproduction fluid; a pump to be positioned at the junction and configured to pump the nonproduction fluid to the at least one lateral well for injection of the nonproduction fluid into a subsurface formation surrounding the at least one lateral well; a first flow channel configured to be a conduit for delivery of the production fluid to the surface of the multilateral well; and a second flow channel configured to deliver an injection of a surface fluid from the surface of the multilateral well into an injection zone downhole in the multilateral well.

Embodiment #1: The multilateral well system of Embodiment #1, wherein at least one of the first flow channel or the second flow channel comprises a tubing string.

Embodiment #3: The multilateral well system of any one of Embodiments #1-2, wherein the surface fluid includes water.

Embodiment #4: The multilateral well system of any one of Embodiments #1-3, wherein the second flow channel is configured to deliver a sample of the nonproduction fluid to the surface of the multilateral well.

Embodiment #5: The multilateral well system of any one of Embodiments #1-4, wherein the injection zone is at least a portion of the subsurface formation surrounding the at least one lateral well.

Embodiment #6: The multilateral well system of any one of Embodiments #1-5, wherein the pump comprises an electrical submersible pump.

Embodiment #7: The multilateral well system of any one of Embodiments #1-6, further comprising an additional pump to be positioned in the first flow channel and further uphole relative to the junction, wherein the additional pump is configured to pump the production fluid to the surface of the multilateral well.

Embodiment #8: The multilateral well system of Embodiment #7, wherein the additional pump comprises an electrical submersible pump.

Embodiment #9: The multilateral well system of any one of Embodiments #1-8, further comprising a packer positioned above the junction and coupled to the first flow channel and the second flow channel.

Embodiment #10: The multilateral well system of any one of Embodiments #1-9, wherein the nonproduction fluid includes water.

Embodiment #11: The multilateral well system of any one of Embodiments #1-10, wherein the production fluid includes hydrocarbons.

Embodiment #12: A multilateral well system comprising: a fluid separator to be positioned at a junction between a main bore and at least one lateral well of a multilateral well, wherein the fluid separator is configured to receive a formation fluid from a subsurface formation surrounding the main bore, wherein the fluid separator is configured to separate the formation fluid into production fluid and nonproduction fluid; a first pump to be positioned at the junction and configured to pump the nonproduction fluid to the at least one lateral well for injection of the nonproduction fluid into a subsurface formation surrounding the at least one lateral well; a first flow channel configured to be a conduit for delivery of the production fluid to a surface of the multilateral well; a second pump to be positioned in the first flow channel and further uphole relative to the junction, wherein the second pump is configured to pump the production fluid to the surface of the multilateral well; and a second flow channel configured to, deliver an injection of a surface fluid from the surface of the multilateral well into an injection zone downhole in the multilateral well; and deliver a sample of the nonproduction fluid to the surface of the multilateral well.

Embodiment #13: The multilateral well system of Embodiment #12, wherein the surface fluid includes water.

Embodiment #14: The multilateral well system of any one of Embodiments #12-13, wherein at least one of the first pump or the second pump comprises an electrical submersible pump.

Embodiment #15: The multilateral well system of any one of Embodiments #12-14, further comprising a packer positioned above the junction and coupled to the first flow channel and the second flow channel.

Embodiment #16: The multilateral well system of any one of Embodiments #12-15, wherein the nonproduction fluid includes water.

Embodiment #17: The multilateral well system of any one of Embodiments #12-16, wherein the production fluid includes hydrocarbons.

Embodiment #18: A method of separating a formation fluid downhole in a multilateral well, the method comprising: drawing the formation fluid in a fluid separator, wherein the fluid separator is located at a junction between a main bore and a lateral well; separating the formation fluid into a production fluid and a nonproduction fluid; drawing production fluid to a surface via a first flow channel; delivering, via a second flow channel, a surface fluid from a surface of the multilateral well downhole; and injecting the nonproduction fluid and the surface fluid into the lateral well and out into a formation surrounding the lateral well.

Embodiment #19: The method of Embodiment #18, wherein the surface fluid includes water.

Embodiment #20: The method of any one of Embodiments #18-19, further comprising: drawing, via the second flow channel, a sample of the nonproduction fluid to the surface of the multilateral well.

Embodiment #21: The method of any one of Embodiments #18-20, further comprising: pumping, via a first pump positioned at a junction between a main bore and at least one lateral well of the multilateral well, the nonproduction fluid to the at least one lateral well for injection of the nonproduction fluid into a subsurface formation surrounding the at least one lateral well.

Embodiment #22: The method of any one of Embodiments #18-21, further comprising: pumping, via a second pump in the first flow channel and further uphole relative to the junction, the production fluid to the surface of the multilateral well.

Embodiment #23: The method of any one of Embodiments #18-22, wherein a packer is positioned above the junction and coupled to the first flow channel and the second flow channel.

Embodiment #24: The method of any one of Embodiments #18-23, wherein the nonproduction fluid includes water.

Embodiment #25: The method of any one of Embodiments #18-24, wherein the production fluid includes hydrocarbons.

The invention claimed is:

1. A multilateral well system comprising:

a fluid separator to be positioned at a junction between a main bore and at least one lateral well of a multilateral well, wherein the fluid separator is configured to receive a formation fluid from a subsurface formation surrounding the main bore, wherein the fluid separator is configured to separate the formation fluid into production fluid and nonproduction fluid;

a pump to be positioned at the junction and configured to pump the nonproduction fluid to the at least one lateral well for injection of the nonproduction fluid into a subsurface formation surrounding the at least one lateral well;

a first flow channel configured to be a conduit for delivery of the production fluid to the surface of the multilateral well; and a second flow channel configured to deliver an injection of a surface fluid from the surface of the multilateral well into an injection zone downhole in the multilateral well.

2. The multilateral well system of claim 1, wherein at least one of the first flow channel or the second flow channel comprises a tubing string.

3. The multilateral well system of claim 1, wherein the surface fluid includes water.

4. The multilateral well system of claim 1, wherein the second flow channel is configured to deliver a sample of the nonproduction fluid to the surface of the multilateral well.

5. The multilateral well system of claim 1, wherein the injection zone is at least a portion of the subsurface formation surrounding the at least one lateral well.

6. The multilateral well system of claim 1, wherein the pump comprises an electrical submersible pump.

7. The multilateral well system of claim 1, further comprising an additional pump to be positioned in the first flow channel and further uphole relative to the junction, wherein the additional pump is configured to pump the production fluid to the surface of the multilateral well.

8. The multilateral well system of claim 1, further comprising a packer positioned above the junction and coupled to the first flow channel and the second flow channel.

9. The multilateral well system of claim 1, wherein the nonproduction fluid includes water and the production fluid includes hydrocarbons.

10. A multilateral well system comprising:

a fluid separator to be positioned at a junction between a main bore and at least one lateral well of a multilateral well, wherein the fluid separator is configured to receive a formation fluid from a subsurface formation surrounding the main bore, wherein the fluid separator is configured to separate the formation fluid into production fluid and nonproduction fluid;

a first pump to be positioned at the junction and configured to pump the nonproduction fluid to the at least one lateral well for injection of the nonproduction fluid into a subsurface formation surrounding the at least one lateral well;

a first flow channel configured to be a conduit for delivery of the production fluid to a surface of the multilateral well;

a second pump to be positioned in the first flow channel and further uphole relative to the junction, wherein the second pump is configured to pump the production fluid to the surface of the multilateral well; and a second flow channel configured to, deliver an injection of a surface fluid from the surface of the multilateral well into an injection zone downhole in the multilateral well; and deliver a sample of the nonproduction fluid to the surface of the multilateral well.

11. The multilateral well system of claim 10, wherein the surface fluid includes water.

12. The multilateral well system of claim 10, wherein at least one of the first pump or the second pump comprises an electrical submersible pump.

13. The multilateral well system of claim 10, further comprising a packer positioned above the junction and coupled to the first flow channel and the second flow channel.

14. The multilateral well system of claim 10, wherein the nonproduction fluid includes water and the production fluid includes hydrocarbons.

15. A method of separating a formation fluid downhole in a multilateral well, the method comprising:

drawing the formation fluid in a fluid separator, wherein the fluid separator is located at a junction between a main bore and a lateral well;

separating the formation fluid into a production fluid and a nonproduction fluid;

drawing production fluid to a surface via a first flow channel;

delivering, via a second flow channel, a surface fluid from a surface of the multilateral well downhole; and injecting the nonproduction fluid and the surface fluid into the lateral well and out into a formation surrounding the lateral well.

16. The method of claim 15, wherein the surface fluid includes water.

17. The method of claim 15, further comprising:

drawing, via the second flow channel, a sample of the nonproduction fluid to the surface of the multilateral well.

18. The method of claim 15, further comprising:

pumping, via a first pump positioned at the junction, the nonproduction fluid to the at least one lateral well for injection of the nonproduction fluid into a subsurface formation surrounding the at least one lateral well.

19. The method of claim 18, further comprising:

pumping, via a second pump in the first flow channel and further uphole relative to the junction, the production fluid to the surface of the multilateral well.

20. The method of claim 15, wherein the nonproduction fluid includes water and the production fluid includes hydrocarbons.

* * * * *